United States Patent [19]

Pietz

[11] Patent Number: 4,758,287

[45] Date of Patent: Jul. 19, 1988

[54] POROUS PROPELLANT GRAIN AND METHOD OF MAKING SAME

[75] Inventor: John F. Pietz, Mesa, Ariz.

[73] Assignee: Talley Industries, Inc., Meza, Ariz.

[21] Appl. No.: 62,547

[22] Filed: Jun. 15, 1987

[51] Int. Cl.[4] ..... C06B 45/00

[52] U.S. Cl. ..... 149/2; 149/35; 149/61; 149/77; 149/109.6; 264/3.1; 102/291; 102/292; 280/728; 280/741

[58] Field of Search ..... 149/2, 35, 61, 77, 109.6; 264/3.1; 280/728, 741; 102/291, 292

[56] References Cited

U.S. PATENT DOCUMENTS

| | | | |
|---|---|---|---|
| 751,385 | 2/1904 | Davis | 102/291 |
| 3,496,870 | 2/1970 | Fulmer | 149/2 |
| 3,691,955 | 9/1972 | Jordan et al. | 102/292 |
| 3,741,585 | 6/1973 | Hendrickson et al. | 280/150 |
| 3,779,819 | 12/1973 | Thomas et al. | 149/2 |
| 3,812,785 | 5/1974 | Cohen et al. | 102/100 |
| 3,883,373 | 5/1975 | Sidebottom | 149/6 |
| 3,895,098 | 7/1975 | Pietz | 423/351 |
| 3,912,561 | 10/1975 | Doin et al. | 149/35 |
| 4,021,275 | 5/1977 | Kishi et al. | 149/35 |
| 4,062,708 | 12/1977 | Goetz | 149/35 |
| 4,094,248 | 6/1978 | Jacobson | 102/100 |
| 4,157,648 | 6/1979 | Brennan et al. | 60/205 |
| 4,339,288 | 7/1982 | Camp | 149/35 |
| 4,376,002 | 3/1983 | Utracki | 149/35 |
| 4,386,569 | 6/1983 | Deas | 102/292 |
| 4,581,998 | 4/1986 | Horst, Jr. et al. | 102/289 |
| 4,604,151 | 8/1986 | Knowlton et al. | 149/35 |
| 4,627,352 | 12/1986 | Brachert et al. | 102/290 |

*Primary Examiner*—Stephen J. Lechert, Jr.
*Attorney, Agent, or Firm*—Pennie & Edmonds

[57] ABSTRACT

A process for preparing a porous propellant grain which comprises blending at least two combustible materials to form a homogeneous mixture, adding a predetermined amount of a liquid dispersant to said mixture to form a slurry, and flash drying the slurry in order to form a porous, single grain propellant having a greatly increased burning surface. A single grain propellant is produced having a flat, torroidal shape with a central cylindrical core and honeycombed with a plurality of porous channels extending entirely through the grain to increase the burning surface thereof.

46 Claims, No Drawings

POROUS PROPELLANT GRAIN AND METHOD OF MAKING SAME

FIELD OF THE INVENTION

The invention relates to porous propellant grains suitable for rapid generation of a gaseous product in applications such as inflating an air cushion device in an automobile passive restraint system.

DESCRIPTION OF THE PRIOR ART

The use of protective gas-inflated bags to cushion vehicle occupants in crash situations is now widely known and well documented. In early systems of this type, a quantity of compressed, stored gas was employed to inflate a crash bag which, when inflated, was positioned between the occupant and the windshield, steering wheel and dashboard of the vehicle. The compressed gas was released by the action of actuators or sensors which sense a rapid change in velocity of the vehicle during a rapid impact, as would normally occur during an accident.

Because of the bulk and weight of the compressed gas apparatus, its generally slow reaction time and attendant maintenance difficulties, stored gas systems have largely been superseded by systems utilizing a gas generated by chemical gas-generating compositions. These systems involve the use of an ignitable propellant for inflating the air cushion, wherein the inflating gas is generated by the exothermic reaction of the reactants which form the propellant.

The bags used in a restraint system of this type must be substantially inflated within a very limited time span, generally on the order of tens of milliseconds, to accomplish their purpose. In addition, the gas thus produced should meet several rather stringent requirements. The temperature of the gas as generated should be low enough so as not to burn the bag, undermine its mechanical strength, or burn the passengers in the vehicle in the event the bag ruptures. The gas used in air bag systems should also be nontoxic and non-noxious, although one may generate a toxic and/or noxious gas, which may be useful for a number of other applications such as those discussed below, by varying the starting materials.

In air bag systems such as those described above, which utilize an ignitable propellant, the stability and reliability of the propellant composition over the life of the vehicle are also very important. Generally, the propellant composition must possess sufficient stability to temperature, humidity and shock so that it is stable and virtually incapable of being set off except upon deliberate initiation by activating sensors employed for this purpose.

Early attempts to develop gas-generating compositions with these features included experiments with, for example, black powder. Although this material generated large quantities of gas upon combustion, it was discarded upon a determination that the products of its combustion were noxious to the automobile occupants who might be subjected to its effects in the event of an air-bag rupture.

One gas, however, which does possess the required characteristics is nitrogen. In the prior art, compositions containing sodium azide as one of the reactants have been utilized to generate pure nitrogen for air bag applications. A number of issued patents relate to such sodium azide-based compositions and to methods for using these compositions to generate large quantities of non-toxic and nonexplosive nitrogen gas. These patents include:

U.S. Pat. No. 3,741,585 to Hendrickson et al., relating to a low temperature nitrogen gas generating composition containing metal azides and reactants such as metallic sulfides, metal oxides, and sulfur.

U.S. Pat. No. 3,883,373 to Sidebottom, relating to a gas generating composition consisting of an alkali or alkaline earth metal azide, an oxidizing compound such as a peroxide, perchlorate, or nitrate, an oxide such as silica or alumina and optionally a metal such as silicon or aluminum.

U.S. Pat. No. 3,895,098 to Pietz, the present applicant, disclosing a gas generating composition in which the reactants are alkali metal azides and a metal oxide. The patent also discloses mixtures of iron, titanium, and copper oxides.

U.S. Pat. No. 3,912,561 to Doin et al., relating to a fuel pyrotechnic composition consisting of an alkali metal azide or alkaline earth azide, an alkali metal oxidant and a nitrogeneous compound such as an amide or tetrazole, with silica as an optional additive.

U.S. Pat. No. 4,021,275 to Kishi et al., relating to a gas generating agent for inflating air bags. The agent is produced by the co-precipitation of at least one alkali metal or alkaline earth metal azide and at least one alkali metal or alkaline earth metal nitrate or perchlorate, preferably in the absence of silicon dioxide or glass powder.

U.S. Pat. No. 4,062,708 to Goetz, disclosing a gas-generating composition consisting essentially of from 10–50% by weight of an oxidizer selected from the oxides of iron, nickel and cobalt and at least about 50% of an alkali metal azide. Optionally, less than 10% of an alkali metal perchlorate may be included as a booster. It is preferred that the mixture of powders be compacted to form pellets of suitable size.

U.S. Pat. No. 4,157,648 to Brennan et al., relating to a method in which nitrogen gas is generated from an alkali metal azide with certain metal halides. The halides are added to prevent the formation of free alkali metal.

U.S. Pat. No. 4,376,002 to Utracki, disclosing a nitrogen gas generating composition consisting of a mixture of one or more alkali metal azides or alkaline earth azides and an oxidant consisting of more than one metal oxide.

U.S. Pat. No. 4,604,151 to Knowlton and Pietz, relating to gas generating compositions comprising an alkali metal azide, preferably sodium azide, in an amount of 55–85% by weight; a metal selected from the oxides of iron, manganese, nickel, copper, cobalt, titanium and tin in an amount of 10–45% by weight and from 1–15% of ammonium perchlorate as a burn rate enhancer.

As employed in automobile passive restraint systems, these compositions have been prepared in the form of powders, granules and pressed tablets or pellets, depending upon the desired reaction time. In order to achieve a sufficient burning surface of the propellant composition, however, most manufacturers of automobile air bag systems have packed their gas generators with a number of generant pellets ranging in size from that of an aspirin to an Alka-Seltzer® tablet. Thus, each inflator unit normally contains anywhere between 40–200 such tablets, the amount depending upon the pellet size chosen. For example, the gas generator currently manufactured by the assignee of the present application utilizes a propellant charge of from 40–50 tablets, each approximately the size of an Alka-Seltzer ® tablet.

Many of the propellant compositions which have been investigated for use with automobile air bag systems also have applications in other areas, such as the related fields of firearms and rocketry. During the launching of a projectile such as a bullet or a rocket, for example, whether from the barrel of a gun or from some other launch mechanism such as a rocket launcher, propellant grains may be utilized having slits or holes aligned along the longitudinal axis thereof in order to provide an increased burning surface. This produces a higher muzzle velocity. Such grains have a perforated "swiss cheese" or "wagon wheel" appearance. Further, these grains have a thinner web structure than a solid grain and they are therefore capable of supporting ignition and resultant combustion on both their inner and outer surfaces.

Examples of propellant grains with these configurations are described in, for example, U.S. Pat. No. 3,812,785 to Cohen, et al. which relates to a solid, unitary propellant grain of generally uniform circular cross section containing a plurality of longitudenal openings extending the length of the grain; U.S. Pat. No. 4,094,248 to Jacobson which describes an extruded, longitudenally grooved, polygonally shaped pellet; U.S. Pat. No. 4,386,569 to Deas which shows a perforated cylindrical grain having a generally hexagonal cross section; U.S. Pat. No. 4,581,998 to Horst, Jr., et al. describing a solid propellant grain provided with a plurality of longitudenal slits therethrough and U.S. Pat. No. 4,627,352 to Brackert, et al. which describes a shaped mass of powder having at least one internal cavity. The perforations within such grains are generally produced, however, by molding the propellant material around a plurality of longitudenally extending mandrels and then removing these inserts so as to produce voids or spaces within the grain.

The manufacture and assembly of a large number of such grains, whether solid or perforated, can be a hazardous operation, however, and requires expensive, heavy-duty pellet presses or molds. In addition, this process requires the expenditure of significant amounts of costly human labor, both in the production of the generants and during the handling and installation of these powder grains within gas generating units, with a corresponding increase in the resultant price of each propellant unit produced.

BRIEF SUMMARY OF THE INVENTION

The applicant has now discovered a process for preparing a porous single grain propellant having a controlled porosity which is greatly enhanced over that obtainable by the prior art. This permits generating a volume of gas from a porous single propellant grain at a rate which was previously achievable for many applications only by the use of multiple grains or, to a limited degree, by mechanically perforated grains. By igniting this porous propellant grain, a volume of gaseous product sufficient for a number of useful applications is produced. The gas thus produced may be either toxic or non-toxic, caustic or non-caustic, depending upon the intended application and the starting materials used. Examples of several such useful applications include the inflation of automobile occupant passive restraint systems, i.e., "airbags", the inflation of life rafts and aircraft escape slides, the dispersion of sub-munitions from airborne munitions packages, prior to impact upon a target, and as a propellant for highly mobile (i.e., shoulder-launched) weapons systems such as ground-to-air rockets, which must almost instantly develop a large amount of thrust while in the launching tube so as to avoid inflicting flash injuries on the soldiers who fire them.

SUMMARY

The process of the invention initially comprises blending a predetermined amount of at least two solid reactants, capable of reacting to form a gaseous reaction product, with a liquid dispersant. By dispersant, applicant means a liquid composition capable of evenly distributing the solids to form a slurry and in which the combustible solid reactants may be partially soluble, i.e., wherein the dispersant has some solvent effect. These combustible materials may either be capable of combustion by themselves or they may be selected to be combustible only in combination with one another.

The solid components may either be mixed directly with the dispersant or one may first dry blend the solids and then subsequently add the dispersant thereto in order to form the slurry. The resultant slurry is then "flash dried" to remove substantially all of the liquid component therefrom, thus forming a propellant grain having a network of porous channels of various diameters. By "flash drying", applicant means a process wherein the liquid component of a slurry material is very quickly brought to a boil so that the liquid is forcibly expelled from the mixture, leaving behind a network of porous channels as the liquid exits the propellant grain.

The slurry composition may optionally be provided with a hardening agent, either added together with the liquid dispersant or by itself in a separate step, to provide strength and stability to the resultant porous propellant grain, thus rendering the grain resistant to abrasion and breakup during handling and/or ignition.

The increased porosity of the single grain propellant produced as decribed above, i.e., without the need for mechanical means to cut or form holes in an otherwise solid propellant grain, provides a sufficient burning surface within the grain to permit, for example, the production of an amount of gaseous product required to inflate an automobile occupant air bag restraint within a period ranging between about 30–60 milliseconds. This elapsed time corresponds to the measured interval between a primary collision involving a motor vehicle and a stationary or moving object and the resultant secondary collision between the driver or passengers and the interior of the vehicle, which the air bag device is intended to prevent.

In one embodiment of the invention, only one of these porous grains may be required for each gas generator, since each grain may be configured and adapted in size and shape to completely fill the propellant chamber of an automobile gas generator. Such porous grains clearly require a minimal amount of labor to install.

A further embodiment of the invention relates to a process for the preparation of porous, single grain propellants for use with automobile air bag systems. The process initially comprises dry blending at least two solid combustible materials, which may either be combustible by themselves or, alternately, only when placed in proximity with one another, to form a homogeneous mixture. These reactants comprise, in one embodiment, an alkali metal azide and a metal oxide. The alkali metal azide may be selected from among sodium azide, potassium azide, lithium azide and mixtures thereof, while the metal oxide may be chosen from iron oxide, copper (II) oxide, manganese oxide, tin oxide, titanium oxide, nickel oxide and mixtures thereof.

The particle size of the azide composition chosen for use with applicant's invention may either be fine, i.e., under 30 microns in size, or coarse, that is, larger than 30 microns. In one embodiment of applicant's invention, a coarse grained azide material may be chosen and, after blending this ingredient with the chosen metal oxide component, a slurry, i.e., dispersion, of these solids may be produced with the addition of a liquid dispersant having the properties of a solvent for the gas generating composition in question, such as water, in which the azide is no more than partially soluble. This partial solubility has the effect of reducing the particle size of the coarse azide, thus increasing the burning rate of a porous propellant grain produced from these materials. This burn rate enhancement effect is clearly to be expected from the well-known teaching in the propellant art that smaller particle sizes produce a greater burning surface and thus facilitate a faster burn rate, all other factors being equal.

Applicant has determined, however, that for the majority of commercial applications in which the porous grain of the invention is to be utilized, the effect of the grain's porosity, by itself, sufficiently increases the combustion surface, and thus the rate of gas generation to permit the formation of the desired amount of gas within the required period of time. A reduction in the particle size of the azide constituent would therefore only produce a supplemental enhancement of the burning rate.

In addition, in the embodiment described above, the particle size reduction effect would not occur with respect to the metal oxide constitutent, since these materials are not soluble in solvents such as water. Therefore, in keeping with the general teaching described above with respect to particle size, it would be useful to utilize a fine grade, as defined above, of the metal oxide.

It is preferable to add to the composition an amount of the metal oxide which is slightly in excess of the stoichoimetric requirement in order to prevent the formation of alkali metals which, because of their flammability, should be avoided in the interest of the safety of the vehicle occupants. Optionally, an additional oxidizing agent, which may be an alkaline nitrate, an alkaline chlorate, an alkaline perchlorate, or a mixture thereof, may be included in the dry blend with the alkaline azide and the metal oxide. Additional burn rate catalysts, well known to those of ordinary skill in the art, may also be included with the mixture.

The homogeneous composition produced by the dry blending technique described above may then be mixed with a sufficient amount of a liquid dispersant to form a slurry thereof. The consistency of the slurry would, of course, be dependent upon the amount of dispersant added to the mixture. The dispersant should be a liquid composition, as described above, which is capable of evenly distributing the solids of the slurry and which is amenable to treatment with microwave radiation. Some possible dispersants include, for example, the aliphatic organic hydrocarbons, such as the aliphatic alcohols (i.e., ethanol, methanol, propanol, etc.) or solvents such as water.

Optionally, the dry blend may be placed into an amount of liquid sufficient to wet all of the solids, whereupon a hardening agent, such as sodium silicate, may subsequently be added in order to complete the production of the slurry. In a further alternate embodiment, the combustible reactants may be added together with the liquid dispersant and blended into the slurry in a single step.

The slurry may then either be extruded into a predetermined shape for drying or it may first be packed into a plastic mold or a plastic combustion cup of the type commonly used to retain the gas generating agent in an automobile gas generator. In either case, the slurry is then exposed to a predetermined amount of microwave radiation sufficient to "flash dry" the liquid component.

Due to the excitation effect which this flash drying technique exerts on the particles of the propellant slurry, a portion or even the entire slurry mixture may be expelled from the mold or combuster cup if the mixture is permitted to become over-excited. In order to control this unwanted effect, the exposure interval of the slurry to the microwave radiation must be carefully controlled. For example, with the use of a 500 watt, 2450 MHz microwave oven, utilizing slurries such as those set forth in Table III, below, applicant has determined that a total exposure time of about 3–5 minutes is effective in providing a sufficiently dry, porous grain, and further, that each period of exposure should not last longer than about 30 seconds when such an oven is utilized for flash-drying purposes, so as not to over-excite the slurry particles. Other types of microwave ovens, well known to those of ordinary skill in the art, may of course be used to flash dry the slurry. The proper heating interval best suited to the particular oven used in such instances may quickly be determined as a matter of routine experimentation.

By the process described above, applicant has been able to produce a porous, single grain propellant which is resistant to abrasion and breakup due to ignition. This propellant grain presents a "wormholed" appearance with a plurality of porous channels extending entirely through the grain. By "wormholed", applicant means a controllable number of randomly oriented porous channels of various diameters, the number and diameter of these channels being controlled by the amount of liquid added to the slurry.

These channels provide a grain having a porous burning surface capable of producing a sufficient amount of gaseous product to substantially fully inflate an automobile air bag within about 30–60 milliseconds after the ignition signal is received. In one embodiment of the invention, this signal may be generated by an electrically activated squib, although alternate means, such as chemical and thermal activation devices, may be employed in alternate embodiments of the invention. The capabilities of the present propellant grain are thus in contrast to large burning surface grains produced by alternate, prior art methods, i.e., propellant grains having the configuration of a "wagon wheel" and grains having a single central cavity, which require between 100+ milliseconds and 2–3 seconds, respectively, for complete combustion.

DETAILED DESCRIPTION OF THE PREFERRED EMBODIMENTS

Applicant has now developed a method for fabricating individual grains of a gas generating composition having a controlled porosity which exposes a burning surface equivalent to the sum of the multiple pellets now used in many gas generators. In addition, despite their porosity, these grains have the physical integrity to survive the normal handling and usage environment due to the inclusion of a hardening agent such as sodium silicate. This assures a defined burning surface when the grain is ignited with an attendant predictable ballistic performance. A grain without this integrity would be subject to abrasion or might break up during use and ignition. Due to a greatly increased burning surface, this could lead to a massive, almost instantaneous build-up in pressure and a resultant catastrophic failure of the gas generator chosen for a specific application.

The currently preferred method of inflating automobile air bags entails using nitrogen gas which is generated by the combustion of an alkaline azide-based propellant. The standard restraining bag for use in protecting automobile drivers has a volume of from about 60–65 liters while a restraining bag for the protection of front seat passengers requires approximately 180–195 liters of gas for substantial inflation. These bags will, because of signal delays, be inflated in about 30–60 milliseconds from the time when the generator begins to function.

In order to substantially inflate an air bag within the time and volume parameters discussed above, a generator must provide a very high mass flow of gas. For example, in a driver's side air bag inflator, the internal mass flow must range between 1,000–3,000 grams/-second. This mass flow ($\dot{w}$) obeys the equation wherein $\dot{w}=\rho r_b A_s$ wherein $\rho$=the density, $r_b$=the burning rate and $A_s$=the burning surface of the propellants.

With regard to the previously described azide-based propellants, which are currently preferred by most manufacturers of automobile passive restraint systems, the average density of these propellants is between about 2.1 to 2.4 g/cm$^3$ and the average burning rate is about 2 to 5 cm/sec, as measured in a Crawford type bomb. This burning rate measurement apparatus is well known among those having ordinary skill in the propellant field. In order to achieve a high mass flow, therefore, a burning surface of at least 300 cm$^2$ is required. As noted above, air bag manufacturers have previously achieved this large burning surface by loading their gas generator units with anywhere from 40 to 200 propellant pellets.

The preferred method for fabricating the porous, single grain propellant of the invention initially involves the formation of a blend of combustible propellant compositions. With regard to the constituents of this combustible blend of materials, a mixture of preferably about 40–80 parts per hundred by weight of an alkali metal azide with about 20–60 parts per hundred by weight of a metal oxide, of a metal lower in the electromotive series than the alkali metal azide, is preferred. Due to the occurrence of spontaneous combustion when alkali metals are exposed to air, however, the metal of the oxide must not be an alkali metal.

Preferred examples of the alkaline azide are sodium, potassium and lithium azides, while the preferred metal oxides are those of iron, copper (II), manganese, tin, titanium and nickel. The most preferred azide for use with automobile air bags is sodium azide, while, with regard to the metal oxide constituent, it is preferred to use either copper (II) oxide, iron oxide or a mixture of copper (II) oxide and iron oxide. Various alternate propellent constitutents, well-known to those skilled in the art of propellant formulation, may be substituted in place of the compositions described above for use in the various applications of applicant's invention which were discusssed previously.

It should be further noted that if there is any excess azide present in the mixture, complete reaction will not occur and an alkali metal, whose presence is undesirable for the reasons stated above, will be formed. To ensure complete reaction of the azide, therefore, it is preferred that the mixture contain a slight stoichiometric excess, i.e., a few percent, of the metal oxide. A mixture containing a stoichiometric excess of the metal oxide is defined as one in which the amount of metal oxide exceeds the amount which represents the theoretical stoichiometric amount. If, however, an amount of metal oxide greater than a few percent above the stoichiometric amount is used, the efficiency of the reaction drops and, consequently, less gas per unit weight of the propellant composition is produced. Additional oxidizing materials, selected from among burning rate catalysts such as alkaline nitrates, chlorates and perchlorates, or any combination thereof, may also be added to the dry blend at stoichiometric levels.

Examples of several dry blend combustible compositions, which may be prepared according to the invention, are set forth in Table I below:

TABLE I

| | DRY BLENDS | | |
|---|---|---|---|
| | Sodium Azide* | Ferric Oxide* (Sicotrans 2175)** | Cupric Oxide* |
| Blend A | 70 | 30 | — |
| Blend B | 65.91 | 14.98 | 19.11 |
| Blend C | 68.31 | 22.00 | 10.19 |
| Blend D | 66.80 | 18.20 | 15.00 |

*all values are given in weight percent
**the particle size of Sicotrans 2175 is approximately 2 microns The resultant dry blend of combustible material is thereafter converted into a thick slurry, preferably by the addition of a predetermined amount of a solution of water and water glass (i.e., sodium silicate solution). Alternatively, however, a predetermined amount of water may be added to the dry blend and stirred until all the solids have been coated with the liquid, after which, the desired amount of silicate solution may be added. The sodium silicate solution may be replaced by other hardening agents such as, for example, liquid plastic components. The purpose of these agents is to impart additional strength to the propellant grain in order to prevent the propellant from becoming abraded or completly breaking up during handling or ignition, which would create a vastly increased surface area and enhance the chances of an explosive ignition. In an optional process for forming the propellant slurry, the combustible reactants may be blended together with the liquid component in a single mixing step.

In addition, the consistency of the slurry may be varied depending upon what further treatment is to be accorded the slurry. That is, if the slurry is to be molded prior to flash drying, it would be acceptable to add sufficient solvent to produce a slurry having a loose consistency, i.e., that of wet coffee grounds. On the other hand, however, slurries which are to be extruded prior to flash drying should have a significantly higher viscosity, i.e., that of a putty.

Table II, below, describes a series of slurry compositions utilizing only acicular iron oxide (Sicotrans 2175) as the oxidizer. By acicular, applicant means a needle-like form of iron oxide wherein the length of the needle measures greater than the width thereof. As noted in Table I, Sicotrans 2175 has a particle size of approximately 2 microns. These slurries, i.e., Slurry A to Slurry E, were prepared in order to study how best to wet the solids and to determine how much liquid was necessary to obtain a workable slurry. In the case of Slurry A, B and C, the sodium silicate was diluted with a predetermined amount of water and then the liquid mixture was added to the dry blend. These slurries required the addition of from about 34–45% water to achieve an appropriate consistency. Slurries D and E had the water added to the solids, after which they were stirred until well mixed and then a predetermined amount of sodium silicate solution was added. This process produced adequate slurries comprising less than 20% water.

TABLE II

| | SLURRIES | | |
|---|---|---|---|
| | Blend A dry mix* | Sodium Silicate Solution (45%)* | Water* |
| Slurry A (1) | 59.66 | 5.88 | 34.46 |
| Slurry B (2) | 49.93 | 5.09 | 44.98 |
| Slurry C (3) | 50.24 | 13.97 | 35.79 |
| Slurry D (4) | 75.58 | 9.83 | 16.59 |
| Slurry E (4) | 73.35 | 9.84 | 16.81 |

*measured in weight percent
(1) = The silicate and water were mixed, then added to Blend A. The mixture had the consistency of soft cake frosting.
(2) = The mixture had the consistency of mustard. When flash dried for 2 minutes, the mixture foamed.
(3) = The mixture had the consistency of soft cake frosting. When flash dried for 2 minutes, the mixture foamed.
(4) = Water was added to the solids, then stirred until the solids were wet and the silicate was added. The mixture was stirred again until it possessed the consistency of wet coffee grounds. 100 grams were flash dried for four minutes in ½ minute intervals.

A further series of slurries was subsequently prepared using dry blend compositions containing mixtures of ferric oxide and cupric oxide as set forth in Table I. The formulation of these slurries appears in Table III, below.

TABLE III

| | SLURRIES | | | | | |
|---|---|---|---|---|---|---|
| | Blend A | Blend B | Blend C | Blend D | Sodium Silicate (45%) | Water |
| Slurry F (1) | 73.66 | | | | 5.29 | 21.09 |
| Slurry G (2) | | 75.0 | | | 10 | 15 |
| Slurry H (2) | | | 74.45 | | 10.2 | 15.31 |
| Slurry I (2) | | | | 75 | 15 | 10 |
| Slurry J (2) | | | | 70.94 | 18.92 | 10.13 |
| Slurry K (2) | | | | 71.43 | 19.06 | 9.51 |

(1) = The mixture had the consistency of cake frosting - it was subsequently flash dried for 4 minutes in ½ minute intervals.
(2) = The mixture had the consistency of wet coffee grounds - it was subsequently flash dried for 4 minutes in ½ minute intervals.

The slurries listed in Table III were produced, as previously described, by adding the necessary amount of water to the dry blend in order to produce a mixture having a paste-like consistency, stirring the resultant paste and then adding a predetermined amount of a 45% sodium silicate solution.

While still in a slurry state, the material may be transferred to a plastic mold or a plastic combustor cup may be utilized as a mold. Such a combuster cup should preferably be of the type commonly utilized in automobile air bag gas generators to hold the generant. The slurry is then flash dried in order to drive the moisture from the mixture. The mold and the combustor cup are preferably constructed of plastic since metal based materials generally cannot be effectively used in microwave ovens.

The preferred method of flash drying the slurry material comprises placing the slurry-filled combustor cup into a microwave oven where it may be subjected for an appropriate period to the microwave radiation produced therein. In one embodiment of applicant's formulation process, a 500 watt, 2,450 MHz microwave oven was utilized to flash dry the slurry. This radiation treatment causes the water to violently boil out of the grain, leaving behind a plurality of porous channels of varying dimension which provide a greatly increased burning surface over normally pressed single grains, i.e., those produced by previously practiced methods, which have only one-fourth the burning surface necessary to produce a desired amount of gas to substantially inflate an automobile air bag device with the use of a single propellant grain.

The apparent density of the single grain propellant may be determined by the formula: density=mass/volume. For example, the calculated density of a standard, i.e., non-porous propellant grain formulated from a mixture of sodium azide and copper oxide, is 2.3 grams/cm$^3$ while the density of applicant's porous grain may range from between about 0.85–1.45 grams/cm$^3$. Thus, by dividing the apparent density of applicant's grain by the "standard" density, i.e., 2.3 grams/cm$^3$, the percent of applicant's porous propellant grain which is comprised of solid materials may be calculated to range from 37–63% and thus the percentage of pores or voids in the grain may be calculated to be between about 63–37%. It is these pores which provide the additional surface area within the grain necessary to support a sufficiently rapid combustion.

Although the flash-drying technique has proven to be an excellent method for removing water from the slurry, the exposure time to the microwave radiation must be carefully controlled. In this regard, it has been determined that the microwaving technique has a tendency to eject particles, and even the entire grain, from the combustor cup or mold when prolonged exposure periods are attempted. It has therefore been determined, with respect to the method disclosed for these examples, that the optimum exposure of the slurry to the radiation produced by the oven described above should be limited to about 30 seconds during any one exposure period. A period of irradiation totaling four minutes, carried out in eight, one-half minute intervals, was required to dry the finished grain of the example. The grains thus produced weighed about 80 grams each and had the general appearance and strength of fired clay.

In instances where a different microwave radiation source is utilized to flash dry the propellant grain, the required exposure intervals may easily be determined. Any other flash drying techniques which are well-known to those in the art may optionally be substituted for the microwave procedure described above. Furthermore, in instances where dispersants other than water are utilized, however, the wavelength of the microwave radiation utilized to dry the pellet must be adjusted to excite the liquid enough to bring it to a rapid boil and to force the liquid out of the propellant grain, thus increasing the porosity of the grain to acceptable levels and ensuring the uniform distribution of the resultant porous channels.

These porous grains are preferably fabricated as a toroidal disc measuring 5.6 cm in diameter and 2.6 cm in length with a cylindrical channel extending through the central portion thereof, from the lower surface of the pellet to the upper surface, said channel measuring 1.25 cm in diameter. The channel completely envelops the outer surface of the igniter chamber within the gas generator as these generators are currently constructed. In a further optional construction, the propellant may be fabricated as a flat, solid, porous propellant grain having no central cavity. A single grain having the latter configuration is considered to be just one of the possible variations obtainable by the use of applicant's novel process. As an alternate optional configuration one may also produce single grains having a plurality of cylindrical channels extending therethrough from the top to the bottom thereof in order to control the resultant burn pattern.

A further alternate method for the production of porous, single-grain propellants as presently disclosed concerns the use of an extruder apparatus. A supply of a slurry having the required consistency may be placed into the extruder in order to extrude a grain having the desired shape, such as one which completely fills the combuster portion of an automobile air bag inflation device. This grain would then be flash dried in the manner described above to produce the final product.

The porous, single-grain propellants produced by the process of the present invention have a wormholed configuration wherein a plurality of open tubular channels, formed by the rapid boiling away of the liquid portion of the slurry during the flash drying process, are produced to greatly expand the accessible burning surface. The size of these channels may range from submicroscopic to a diameter visible to the naked eye, depending upon the volume chosen for the liquid constituent of the slurry. These channels are, however, of a size sufficiently large to permit contact between the advancing flame front and the inner burning surface of the propellant grain. This faciliates the formation of a sufficient amount of the gaseous product to substantially inflate an automobile air bag in 30–60 milliseconds.

While it is apparent that the invention herein disclosed is well calculated to fulfill the objectives stated above, it will be appreciated that numerous modifications and embodiments may be devised by those skilled in the art, and it is intended that the appended claims cover all such modifications and embodiments as fall within the true spirit and scope of the present invention.

I claim:

1. A process for preparing a porous propellant grain which comprises:

blending a predetermined amount of at least two combustible materials, said materials being capable of rapidly reacting to generate a gaseous product, and a liquid dispersant to form a slurry; and flash drying said slurry to substantially evaporate said dispersant and form a porous propellant grain.

2. A process for preparing a porous propellant grain which comprises:

blending a predetermined amount of at least two combustible materials to form a homogeneous mixture, said materials capable of rapidly reacting to generate a non-toxic, non-noxious gas;

adding a predetermined amount of a liquid dispersant to said mixture to form a slurry; and flash drying said slurry in order to evaporate said dispersant and form a porous propellant grain having a burning surface capable of producing a desired amount of gaseous product to substantially fully inflate an automobile air bag in about 30–60 milliseconds.

3. The process of claim 1 or 2 wherein said combustible materials comprise at least an alkali metal azide and a metal oxide.

4. The process of claim 3 wherein the alkali metal azide is sodium azide, potassium azide, lithium azide or mixtures thereof.

5. The process of claim 4 wherein said azide is sodium azide, said azide being added in an amount of between about 40–80 parts per hundred by weight of the total composition.

6. The process of claim 3 wherein said metal oxide is added to said azide in an amount slightly in excess of the stoichiometric requirement.

7. The process of claim 6 wherein the metal oxide is ferric oxide, copper (II) oxide, manganese oxide, tin oxide, titanium oxide, nickel oxide and mixtures thereof.

8. The process of claim 1 or 2 which further comprises adding a stoichiometric amount of at least one oxidizing agent to said mixture.

9. The process of claim 8 wherein said oxidizing agent is an alkaline nitrate, an alkaline chlorate, an alkaline perchlorate or a mixture thereof.

10. The process of claim 1 or 2 wherein said blending step is performed by dry mixing the combustible reactants.

11. The process of claim 1 or 2 wherein said liquid dispersant comprises a solution of sodium silicate in water.

12. The process of claim 11 wherein the percentage of sodium silicate in said solution ranges between about 10–70% by weight.

13. The process of claim 1 or 2 wherein said liquid dispersant is water and which further comprises adding a predetermined amount of a sodium silicate solution to said slurry.

14. The process of claim 1 or 2 wherein said liquid dispersant is an aliphatic hydrocarbon compound.

15. A process for preparing a porous propellant grain which comprises:

dry blending a mixture of 40–80 parts per hundred by weight of a sodium azide and from about 20–60 parts per hundred by weight of a mixture of ferric oxide and cupric oxide, said metal oxide being added in an amount slightly in excess of the stoichiometric requirement, with an oxidizing agent selected from among an alkaline nitrate, an alkaline chlorate, an alkaline perchlorate and mixtures thereof, to form a homogeneous mixture;

adding a predetermined amount of a solution of sodium silicate in water to said mixture to form a slurry; and flash drying said slurry in order to evaporate water from the slurry and form a porous, single-grain propellant composition with a sufficient burning surface capable of producing a desired amount of gaseous product to substantially fully inflate an automobile air bag in about 30–60 milliseconds.

16. The process of claim 1 or 2 wherein said slurry is flash dried by exposure to a predetermined level of microwave radiation for a predetermined duration to remove substantially all of the water therefrom.

17. The process of claim 1 or 2 which further comprises molding a quantity of said slurry into a predetermined shape prior to flash drying said slurry.

18. The process of claim 17 which further comprises filling a plastic combuster cup with a predetermined amount of said slurry in order to mold said slurry into a predetermined shape prior to exposing the slurry to said microwave radiation.

19. The process of claim 16 wherein said slurry is irradiated for about 30 seconds during any one exposure period.

20. The process of claim 19 wherein the total period during which said slurry is exposed to said radiation is about four minutes in order to remove substantially all of the liquid therefrom.

21. The process of claim 1 or 2 which further comprises extruding a quantity of said slurry into a predetermined shape prior to flash drying said extrudate.

22. A process for preparing a porous propellant grain which comprises:

dry blending 40–80 parts per hundred by weight of an alkali metal azide selected from among sodium azide, potassium azide, lithium azide and mixtures thereof together with about 20–60 parts per hundred by weight of a metal oxide selected from among iron oxide, copper (II) oxide, manganese oxide, tin oxide, titanium oxide, nickel oxide and mixtures thereof, said amount of metal oxide being slightly in excess of the stoichiometric requirement and an additional oxidizing agent selected from among an alkaline nitrate, an alkaline chlorate, an alkaline perchlorate and mixtures thereof, to form a homogeneous mixture;

adding a predetermined amount of a sodium slicate solution in water to said mixture to form a slurry wherein the percentage of said sodium silicate ranges between 10–70% by weight;

placing said slurry into an automobile gas generator combuster cup in an amount sufficient to substantially fill said cup so as to mold the slurry into a predetermined shape; and irradiating said slurry with a source of microwave radiation for a period of about 3–5 minutes, wherein said period is comprised of a plurality of discrete radiation treatments, each lasting about 30 seconds, to evaporate substantially all of the water from the slurry and form a porous, single grain propellant having a burning surface capable of producing a desired amount of gaseous product to substantially fully inflate an automobile air bag in about 30–60 milliseconds.

23. A process for rapidly generating a quantity of a gaseous product which comprises:

preparing a porous propellant grain by blending a predetermined amount of at least two combustible materials, said materials capable of rapidly reacting to generate a gaseous product, and a liquid dispersant to form a slurry; and flash drying said slurry to substantially evaporate said dispersant, thus forming said porous grain; and igniting said grain so as to produce a desired quantity of gaseous product.

24. The process of claim 23 which further comprises placing said porous grain within combustion means prior to said ignition step.

25. The process of claim 24 wherein said combustion means is chamber means, said chamber means forming a portion of a gas generator assembly.

26. The process of claim 25 which further comprises installing said gas generator assembly in a motor vehicle as a portion of an occupant passive restraint system.

27. The process of claim 25 which further comprises substantially inflating an expandable safety device with said gaseous product.

28. The process of claim 27 which further comprises selecting said expandable safety device from among an aircraft escape slide, an inflatable life raft and an automobile air bag.

29. The process of claim 23 which further comprises utilizing said gaseous product to propel projectile means.

30. The process of claim 23 wherein said combustible materials comprise at least an alkali metal azide and a metal oxide.

31. The process of claim 23 which further comprises dry blending said combustible materials to form a homogeneous mixture and subsequently adding a predetermined amount of a liquid dispersant thereto in order to form said slurry.

32. The process of claim 23 which further comprises igniting said porous grain by chemical, electrical or thermal means.

33. The process of claim 32 wherein said electrical means is electrically activated squib means.

34. A process for rapidly generating a desired quantity of a gaseous product to substantially fully inflate an automobile air bag in between about 30–60 milliseconds which comprises:

preparing a porous propellant grain by blending a predetermined amount of at least an alkali metal azide and a metal oxide, said azide and said oxide capable of rapidly reacting to generate a nonnoxious, non-toxic gaseous product, and an aqueous dispersant to form a slurry; and flash drying said slurry to substantially evaporate said dispersant, thus forming said porous grain;

placing said porous grain within a combustion chamber portion of an automotive air bag gas generator assembly; and igniting said porous grain to generate said gas.

35. The porous propellant grain prepared by the process of claim 1.

36. The porous propellant grain prepared by the process of claim 2.

37. The porous propellant grain prepared by the process of claim 15.

38. The porous propellant grain prepared by the process of claim 22.

39. A porous propellant grain wherein said grain has a plurality of randomly oriented, radial and longitudinally interconnected porous channels having a variety of diameters, extending entirely through said grain to increase the burning surface of said grain.

40. The porous propellant grain of claim 39 wherein the density of said grain ranges between about 0.85–1.45 grams/cm$^3$.

41. The porous propellant grain of claim 39 wherein said grain is resistant to abrasion and breakup during loading within an automobile gas generator and upon ignition.

42. The porous propellant grain of claim 39 wherein said grain is produced having a flat torroidal shape.

43. The porous propellant grain of claim 42 wherein said grain further defines a central cylindrical channel extending therethrough from a bottom surface to a top surface thereof, configured to completely surround an igniter portion of an automobile gas generator.

44. A porous propellant grain resistant to abrasion and breakup during loading into a gas generator and upon ignition thereof, wherein said grain has a plurality of randomly oriented uniformly distributed porous channels extending entirely therethrough, having a variety of diameters, said channels being radially and longitudinally interconnected to increase the burning surface of said grain, said grain having a density of between about 0.85–1.45 grams/cm$^3$, and having a flat, torroidal shape.

45. A porous propellant grain resistant to abrasion and breakup during loading into a gas generator and upon ignition thereof, comprising a homogeneous mixture of at least two combustible reactants, said mixture containing a plurality of randomly oriented porous channels having a variety of diameters, uniformly distributed therethrough, said channels being radially and longitudinally interconnected to provide a sufficient burning surface for rapidly producing a large quantity of gaseous product upon ignition of said propellant.

46. The porous propellant grain of claim 45 wherein the reactants include an azide compound and a transition metal oxide, with the oxide present in an amount in excess of the stoichiometric requirement.

* * * * *